US007486249B2

(12) United States Patent
Fujita et al.

(10) Patent No.: US 7,486,249 B2
(45) Date of Patent: Feb. 3, 2009

(54) ANTENNA

(75) Inventors: Toshio Fujita, Kobe (JP); Shingo Fujisawa, Kobe (JP)

(73) Assignee: DX Antenna Company, Ltd., Kobe-shi (JP)

( * ) Notice: Subject to any disclaimer, the term of this patent is extended or adjusted under 35 U.S.C. 154(b) by 49 days.

(21) Appl. No.: 11/602,352

(22) Filed: Nov. 21, 2006

(65) Prior Publication Data

US 2007/0063909 A1 Mar. 22, 2007

(51) Int. Cl.
*H01Q 9/28* (2006.01)

(52) U.S. Cl. ..... 343/795; 343/700 MS

(58) Field of Classification Search ..... 343/700 MS, 343/795, 793, 797
See application file for complete search history.

(56) References Cited

U.S. PATENT DOCUMENTS 3,369,245 A * 2/1968 Rea ..... 343/795
3,721,990 A * 3/1973 Gibson et al. ..... 343/726
6,914,558 B1 * 7/2005 Shirosaka et al. ..... 342/371
7,019,704 B2 * 3/2006 Weiss ..... 343/770
7,050,013 B2 * 5/2006 Kim et al. ..... 343/770
2007/0176838 A1 * 8/2007 Zink et al. ..... 343/797

FOREIGN PATENT DOCUMENTS

JP 49-40651 4/1974

* cited by examiner

*Primary Examiner*—HoangAnh T Le
(74) *Attorney, Agent, or Firm*—Birch, Stewart, Kolasch & Birch, LLP

(57) ABSTRACT

A radiator includes two dipole elements as plate-shaped conductors. The radiator further includes two conductive line portions provided on opposite sides of a prescribed axis, sandwiching both of the two dipole elements, each having one end connected to one dipole element and the other end connected to the other dipole element. The two conductive line portions are formed to conform to the shapes of the dipole elements. As the conductive line portions having such shapes are connected to the dipole elements, better characteristics can be attained over wide frequency range and the size can be made smaller than the conventional radiator. Thus, an antenna having smaller size and improved characteristics can be provided.

8 Claims, 18 Drawing Sheets

| PATTERN | SW1 | SW2 | OUTPUT OF POLARITY INVERTER | SW3 | DIRECTIVITY CHARACTERISTIC (RADIATOR 3KA) | DIRECTIVITY CHARACTERISTIC (RADIATOR 3KB) | COMBINED DIRECTIVITY CHARACTERISTIC |
|---|---|---|---|---|---|---|---|
| 1 | A1 | — | — | A3 |   | — |   |
| 2 | B1 | A2 | NON-INVERSION | B3 |   |   |   |
| 3 | — | B2 | — | C3 | — |   |   |
| 4 | B1 | A2 | INVERSION | B3 |   |   |   |

ANTENNA

This nonprovisional application is based on Japanese Patent Application No. 2004-341748 filed with the Japan Patent Office on Nov. 26, 2004, the entire contents of which are hereby incorporated by reference.

BACKGROUND OF THE INVENTION

1. Field of the Invention

The present invention relates to an antenna and, specifically, to an antenna including a radiator made smaller than a conventional radiator.

2. Description of the Background Art

A general antenna includes a radiator as a device for transmitting and receiving radio waves. By way of example, a Yagi antenna generally used for receiving television broadcast signals is formed of a director, a radiator and a reflector.

Conventionally, various and many techniques related to antennas have been disclosed. For example, Japanese Patent Laying-Open No. 49-040651 discloses a jig, which has holes for forming conductive patterns corresponding to antenna shapes by applying conductive coating, for mass-producing various antennas including conical antenna and Yagi antenna in a simple manner.

Antenna types vary widely, and antennas have various names reflecting operation principle, characteristics or shape. One type of such antennas is "fan-shaped dipole antenna." The fan-shaped dipole antenna is characterized by its wide range of operable frequency.

FIG. 18 shows an example of the fan-shaped dipole antenna.

Referring to FIG. 18, a radiator 103 includes dipole elements 110 and 112, which are plate-shaped conductors. Dipole elements 110 and 112 are provided in symmetry about a Y-axis, and respectively connected to a power feed line (such as a feeder or a coaxial cable) at power feed points 114 and 116. Each of the dipole elements 110 and 112 has a trapezoidal or triangular shape, having its width along the Y-axis direction made wider further away from the power feed point.

The dimensions in the X-axis direction and Y-axis direction of radiator 103 are 210 mm and 76 mm, respectively. Generally, frequency range of radio wave that can be received by an antenna depends on the length and width of the radiator. Radiator 103 is used for receiving radio wave of UHF (Ultra High Frequency) television broadcast.

FIG. 19 is a graph representing a characteristic of radiator 103 shown in FIG. 18.

Referring to FIG. 19, the abscissa of the graph represents frequency, and the ordinate represents VSWR (Voltage Standing Wave Ratio).

In FIG. 19, the frequency range is 470 MHz to 806 MHz, which range covers both UHF television broadcast frequency ranges of Japan and the United States. In Japan, frequency range of broadcast radio wave of UHF television broadcast is 470 to 770 MHz (13 to 62 channels). Particularly, frequency range of digital terrestrial broadcast is 470 to 710 MHz (13 to 52 channels). In the United States, frequency range of broadcast radio wave of UHF television broadcast is 470 to 806 MHz.

In FIG. 19, a curve G100 represents variation of gain with respect to the frequency, while a curve V100 represents variation of VSWR with respect to the frequency. The gain becomes higher as the frequency is higher, and peaks around 761 MHz. On the other hand, VSWR lowers as the frequency becomes higher. The frequency at which the gain attains as high as possible and VSWR attains as low as possible corresponds to the peak antenna characteristic. In the example shown in FIG. 19, the antenna characteristic peaks at a frequency near 761 MHz.

FIG. 20 is a graph representing another characteristic of radiator 103 shown in FIG. 18.

Referring to FIG. 20, the abscissa of the graph represents frequency, and the ordinate represents half width (indicated by H.P.A (H.P.A is an abbreviation of 'Half Power Angle'.) in the graph) and front-to-back ratio (indicated by F/B in the graph). The half width is an angular width at which the radiation intensity (radiation power) attains one-half (½) the maximum value. The front-to-back ratio is the ratio of radiation intensity in the direction of a reference point (angle 0°) to radiation intensity in the direction in the range of 180°±90° from the direction of the reference point. It is noted that directivity of the antenna transmitting radio waves is the same as the directivity of the antenna receiving the radio waves.

A curve H100 represents variation in the half-width with respect to the frequency, and a curve F100 represents variation in the front-to-back ratio with respect to the frequency. As can be seen from curve H100, the half-width becomes smaller as the frequency is higher (beam width becomes narrower). In contrast, the front-to-back ratio is kept around 0 dB regardless of the variation in frequency, as indicated by curve F100.

In FIG. 19, the frequency at which antenna characteristic peaks is around 761 MHz and considerably different from the center (around 653 MHz) of the frequency range. From the practical viewpoint, when the characteristic peak is to be set near the center of frequency range, the length of radiator 103 in the X-axis direction must be made longer than 210 mm.

When an antenna is installed outside, a longer radiator poses no problem as there is sufficient space. An indoor antenna, however, has restrictions in installation space and position. Therefore, an indoor antenna must be as small as possible, and hence, a radiator for an indoor antenna should preferably be as small as possible.

A small radiator may be used both for an outdoor antenna and an indoor antenna. The conventional radiator, however, unavoidably becomes large when better characteristics are to be realized, and reduction in size has been difficult.

SUMMARY OF THE INVENTION

The present invention was made to solve the above-described problems, and its object is to provide an antenna including a radiator of improved characteristics and reduced size.

In short, the present invention provides an antenna, including first and second dipole elements respectively having power feed points provided on a first axis, and symmetrical in shape with each other about a second axis perpendicularly crossing the first axis at a mid point of a line connecting the respective power feed points. Each of the first and second dipole elements are formed, at least partially, to be wider in a direction of the second axis away from the mid point on the second axis along the first axis. The antenna further includes first and second conductive line portions provided on opposite sides of the first axis, sandwiching both the first and second dipole elements, each having one end connected to a tip end portion of the first dipole element and the other end connected to a tip end portion of the second dipole element. The first and second conductive line portions are formed conforming to the shapes of the first and second dipole elements.

Preferably, the antenna includes: third and fourth dipole elements respectively having power feed points on the second axis and symmetrical in shape with each other about the first axis, provided outer than the first and second conductive line portions with respect to the first and second dipole elements; and third and fourth conductive line portions provided on opposite sides of the second axis, sandwiching both the third and fourth dipole elements, each having one end connected to a tip end portion of the third dipole element and the other end connected to a tip end portion of the fourth dipole element. The third and fourth conductive line portions are provided to extend between the first dipole element and the second dipole element.

More preferably, the third and fourth dipole elements have the same shape as the first and second dipole elements, respectively. The first and second dipole elements each include a first side parallel to the second axis, second and third sides each having one end connected to opposite ends of the first side and widening in a direction of the second axis, fourth and fifth sides parallel to the first axis and connected to the other end of the second and third sides, respectively, and a sixth side having opposite ends connected to the fourth and fifth sides, respectively.

More preferably, a space between the first dipole element and the first conductive line portion, a space between the second dipole element and the first conductive line portion, a space between the first dipole element and the second conductive line portion and a space between the second dipole element and the second conductive line portion are in a range from at least 1 mm to at most 10 mm.

More preferably, the antenna further includes an insulating substrate having a surface for supporting the first to fourth dipole elements and the first to fourth conductive line portions on one same plane.

More preferably, the first to fourth dipole elements and the first to fourth conductive line portions are formed integrally in a plate shape.

More preferably, the antenna further includes a variable directivity circuit changing antenna directivity by controlling power feeding to the first and second dipole elements and power feeding to the third and fourth dipole elements.

More preferably, the antenna receives radio wave of UHF (Ultra High Frequency) band.

Therefore, the antenna in accordance with the present invention includes first and second dipole elements and first and second conductive line portions provided on opposite sides of the first and second dipole elements and each having one end connected to the tip end portion of the first dipole element and the other end connected to the tip end portion of the second dipole element. Accordingly, by the present invention, the antenna can be made smaller and antenna characteristics can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
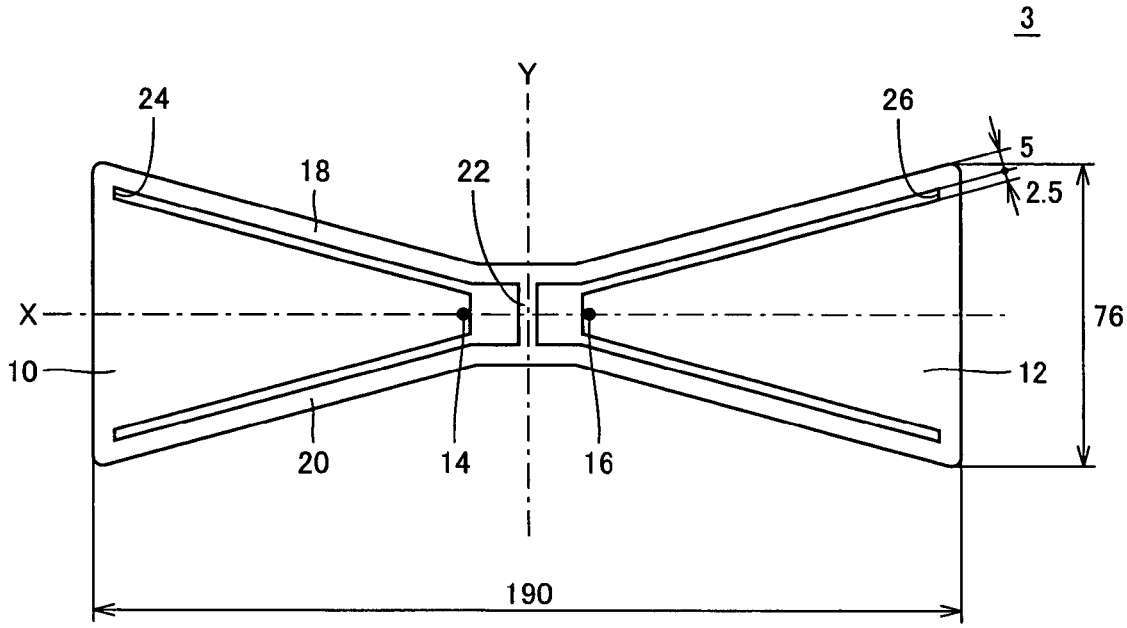
FIG. 1 shows a basic structure of a radiator of the antenna in accordance with an embodiment.

In the following, embodiments of the present invention will be described in detail, with reference to the figures. In the figures, the same reference characters denote the same or corresponding portions.

FIG. 1 shows a basic structure of a radiator of the antenna in accordance with an embodiment.

Referring to FIG. 1, radiator 3 includes dipole elements 10 and 12 formed of a plate-shaped conductor. Dipole elements 10 and 12 have respective power feed points 14 and 16 on the X-axis. Further, the dipole elements 10 and 12 are symmetrical in shape with each other about the Y-axis orthogonally crossing the X-axis at the mid point of a line connecting power feed points 14 and 16, and the shape, at least partially, widens in the direction of the Y-axis away from the mid point, from the Y-axis along the X direction. In FIG. 1, each of the dipole elements 10 and 12 has a trapezoidal shape.

Radiator 3 further includes conductive line portions 18 and 20 provided on opposite sides of the X-axis, sandwiching both dipole elements 10 and 12, each having one end connected to a tip end portion of dipole element 10 and the other end connected to a tip end portion of dipole element 12.

Here, the "tip end portion of dipole element" refers to an end portion of the dipole element at the furthermost distance from the power feed point.

Conductive line portions 18 and 20 are formed to conform to the shapes of dipole elements 10 and 12. As the conductive line portions 18 and 20 of such shapes are connected to dipole elements 10 and 12, better characteristic can be attained in a wider frequency range than by a conventional radiator, and the size can be made smaller.

Figure 18:
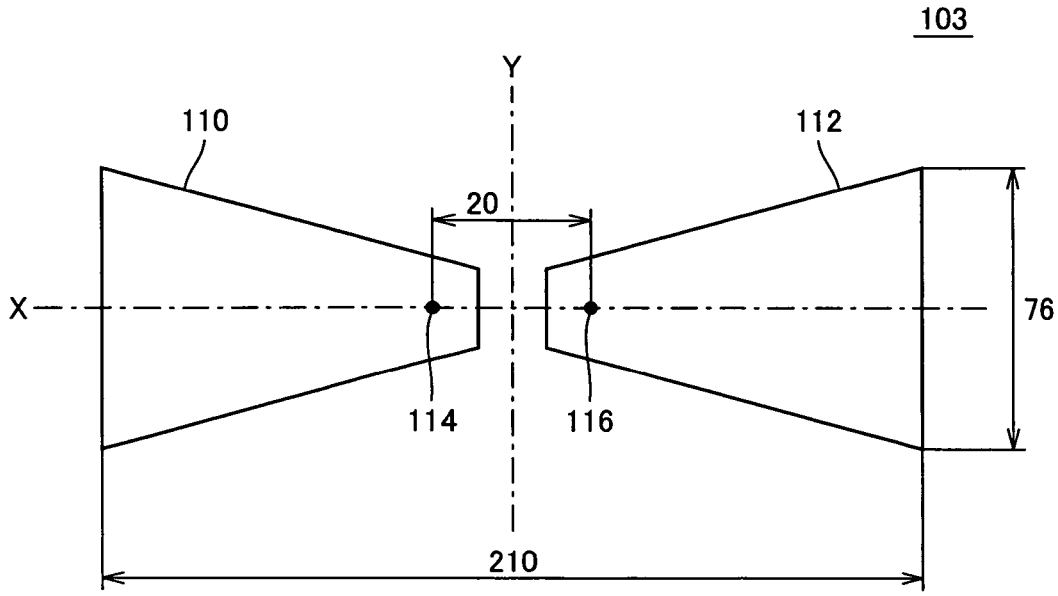
FIG.18 PRIOR ART
FIG. 18 shows an example of a fan-type dipole antenna.

Specifically, radiator 3 has the length of 190 mm along the X-axis direction and 76 mm along the Y-axis direction. When the length in the X-axis direction is compared with that of radiator 103 shown in FIG. 18, radiator 3 is shorter by 20 mm.

Conductive line portions 18 and 20 are connected by a connecting portion 22 formed of metal. Connecting portion 22 is provided to increase strength of radiator 3, and if radiator 3 has sufficient strength, connecting portion 22 may be unnecessary.

Conductive line portions 18 and 20 are provided spaced by a prescribed distance from dipole elements 10 and 12 and, as a result, a slit 24 is formed between dipole element 10 and conductive line portion 18 and between dipole element 10 and conductive line portion 20. Similarly, a slit 26 is formed between dipole element 12 and conductive line portion 18 and between dipole element 12 and conductive line portion 20. The width of slit 24 or 26 is 2.5 mm.

In FIG. 1, dipole elements 10 and 12 and conductive line portions 18 and 20 are formed by integral molding as a plate. Radiator 3 as such may be formed, for example, by press-working sheet metal using a mold. It is also possible, however, to form the radiator of the same shape by connecting metal plates having the same shape as dipole elements 10 and 12 and metal bars having the same shape as conductive line portions 18, 20 and connecting portion 22, by means of solder or the like.

Figure 2:
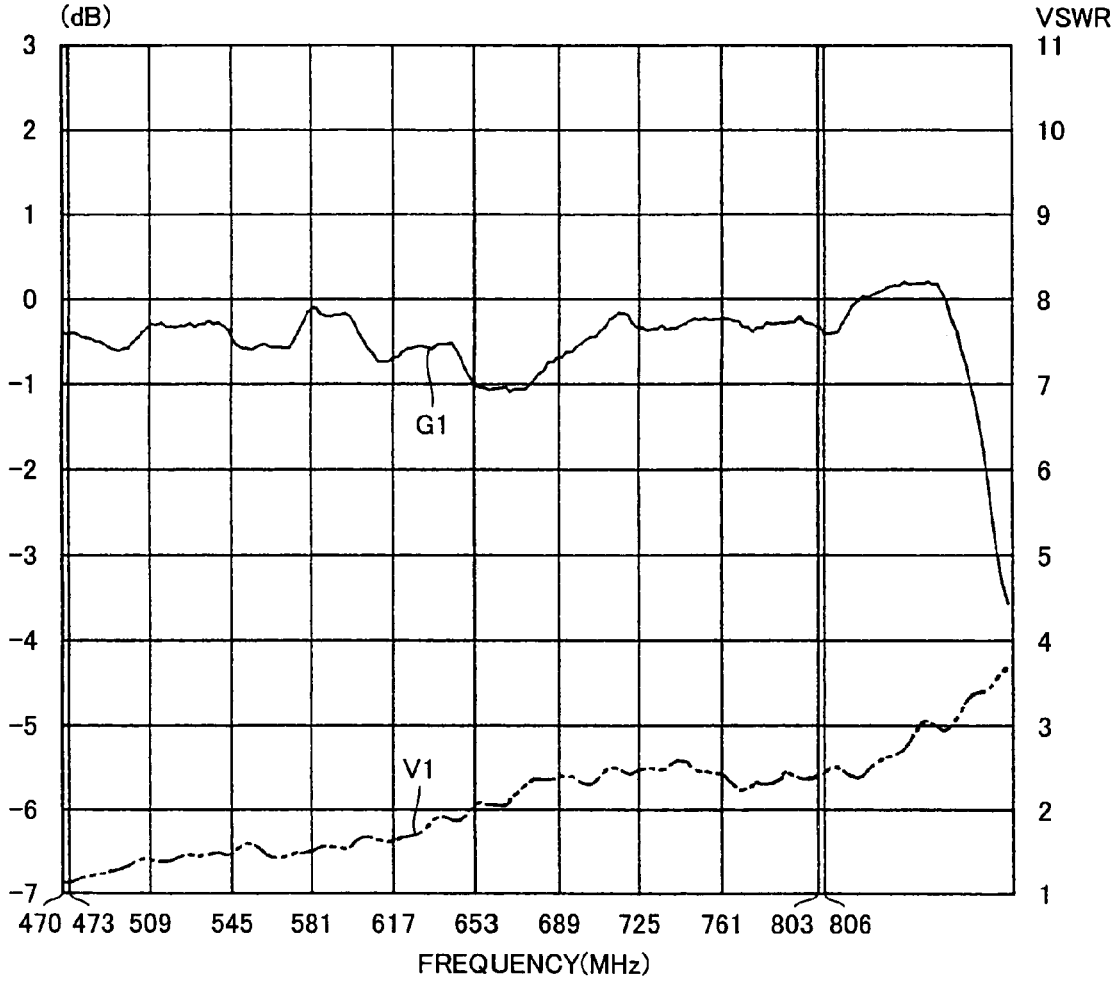
FIG. 2 is a graph representing a characteristic of radiator 3 shown in FIG. 1.

FIG. 2 is a graph representing a characteristic of radiator 3 shown in FIG. 1.

Referring to FIG. 2, the abscissa represents frequency range, and the ordinate represents gain and VSWR. The frequency range is 470 to 806 MHz, as in the example of FIG. 19. A curve G1 shows variation in gain with respect to the frequency, and a curve V1 shows variation in VSWR with respect to the frequency.

The characteristic of radiator 3 will be described, comparing FIGS. 2 and 19. The antenna characteristic is good when gain variation with respect to the frequency is small and VSWR is low (VSWR value of 2.5 or lower is more preferred). In the conventional radiator, the gain becomes higher as the frequency becomes higher as can be seen from the curve G100 of FIG. 19, and the gain varies between −4 dB and 0 dB. Further, as can be seen from curve V100, at the frequency of about 470 MHz, VSWR is 5 or higher, and the value VSWR becomes smaller as the frequency becomes higher.

In contrast, as can be seen from curve G1 of FIG. 2, the gain varies between about 0 dB and −1 dB, and the variation with frequency is smaller than curve G100. Further, as can be seen from curve V1, though the value VSWR increases as the frequency becomes higher, the value is in the range of about 1 to about 3. As described above, in radiator 3, variations in gain and VSWR are small over a wide frequency range, and hence, radiator 3 has better characteristic than the conventional radiator.

Figure 3:
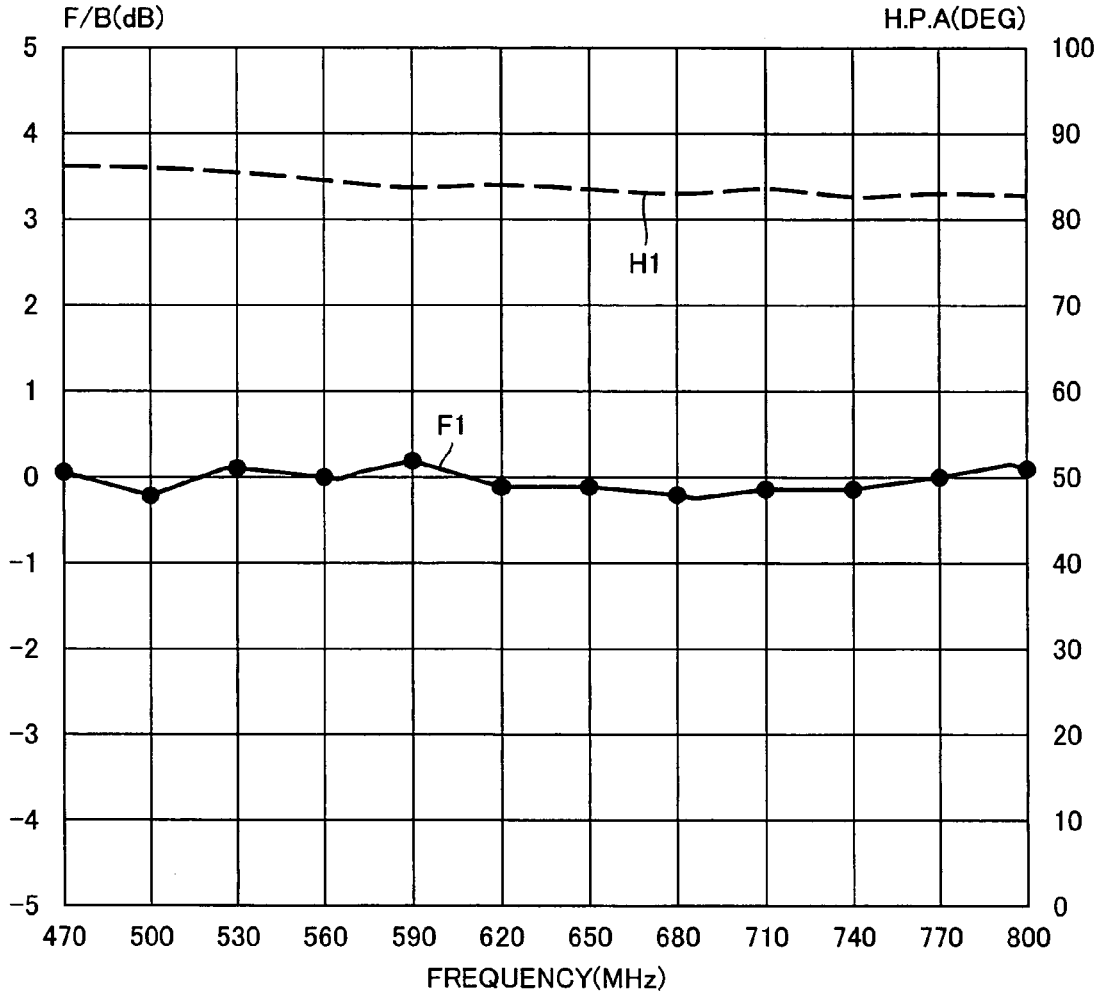
FIG. 3 is a graph representing another characteristic of radiator 3 shown in FIG. 1.

FIG. 3 is a graph representing another characteristic of radiator 3 shown in FIG. 1.

Referring to FIG. 3, the abscissa of the graph represents frequency, and the ordinate represents the half-width and the front-to-back ratio. A curve H1 represents variation in half-width with respect to the frequency, and a curve F1 represents variation in front-to-back ratio with respect to the frequency. The front-to-back ratio is approximately 0 dB with respect to the frequency, and therefore, front-back directivity is symmetrical.

Figure 19:
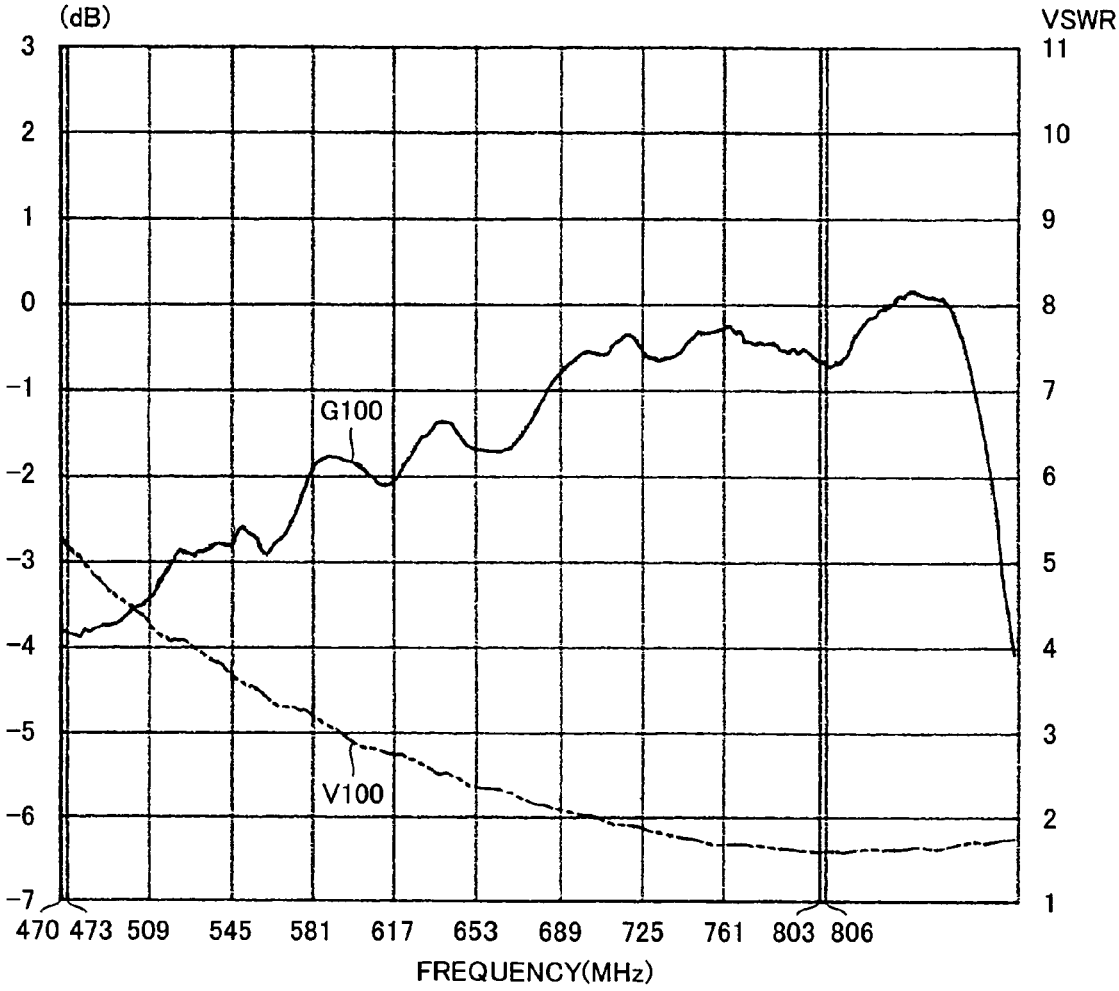
FIG.19 PRIOR ART
FIG. 19 is a graph representing a characteristic of radiator 103 shown in FIG. 18.

As regards the variation in half-width with the frequency, when the curve H1 of FIG. 3 is compared with the curve H100 of FIG. 19, the variation of curve H1 is more moderate than curve H100. Therefore, by way of example, when two beams in directions different by 90° are combined using two radiators crossing at right angles, decrease in strength of the received power at the angle of 45° can be suppressed.

Figure 4:
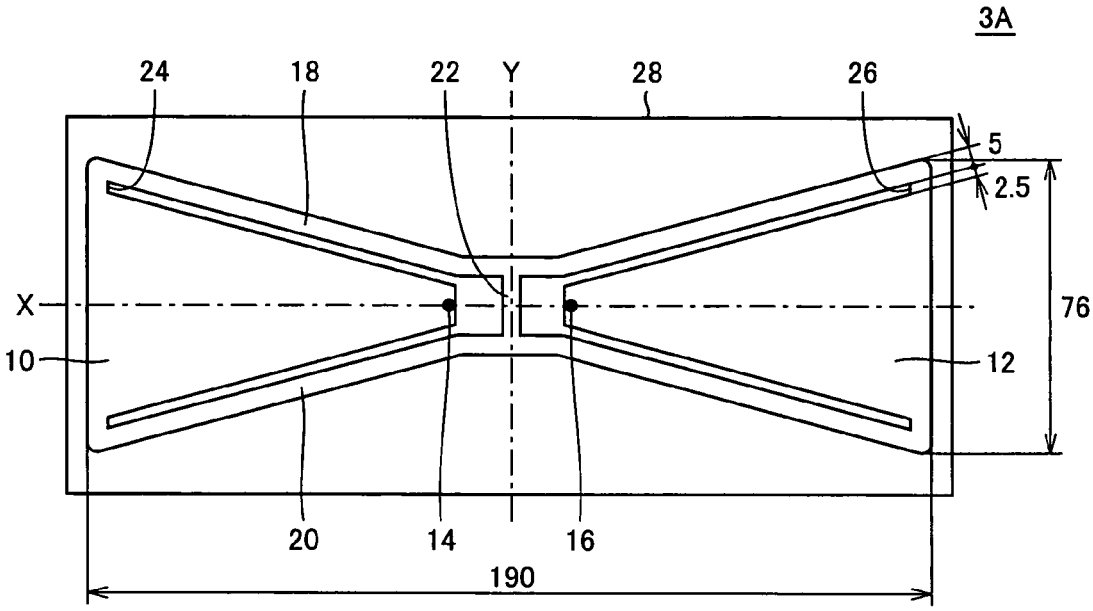
FIG. 4 shows a variation of radiator 3 of FIG. 1.

FIG. 4 shows a variation of radiator 3 of FIG. 1.

Referring to FIG. 4, a radiator 3A differs from radiator 3 of FIG. 1 in that it additionally includes an insulating substrate 28. Except for this point, radiator 3A is the same as radiator 3, and therefore, description thereof will not be repeated. In radiator 3A, dipole elements 10 and 12, conductive line portions 18 and 20 and connecting portion 22 are adhered on a surface of insulating substrate 28, and therefore, dipole elements 10 and 12 and conductive line portions 18 and 20 can be held on one same plane. Thus, strength of the radiator can be improved.

Radiator 3A may be manufactured by adhering a metal plate formed to have the shape of radiator 3 of FIG. 1 to the insulating substrate, or it may be manufactured by providing a metal film and a resist film on a surface of the insulating substrate, forming a mask pattern on the resist film and etching the metal film.

Figure 5:
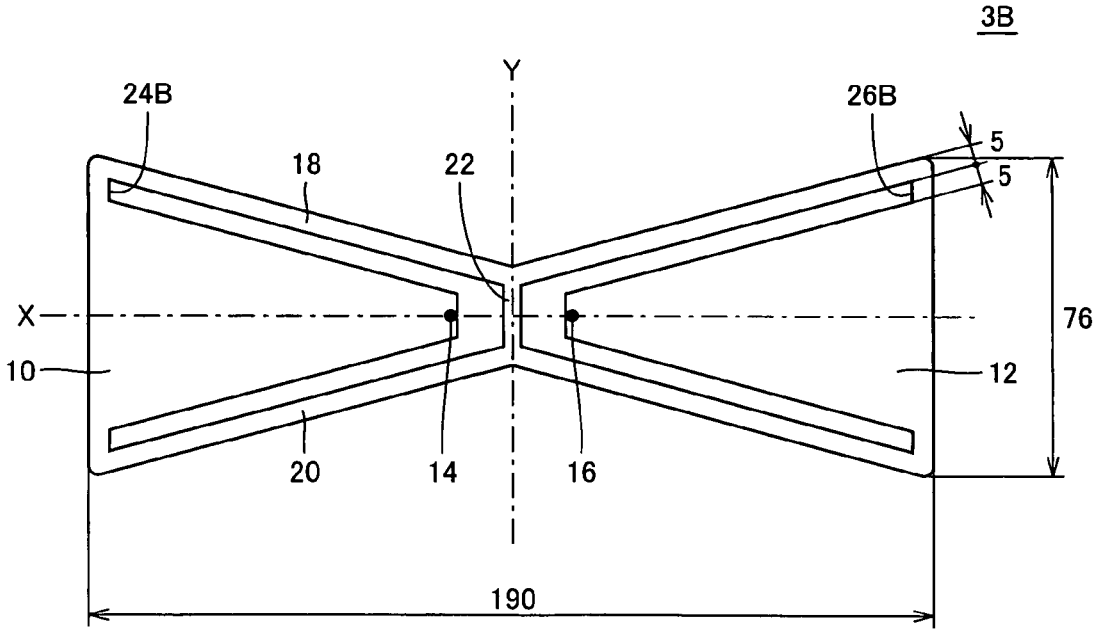
FIG. 5 shows another variation of radiator 3 of FIG. 1.

FIG. 5 shows another variation of radiator 3 of FIG. 1.

Referring to FIG. 5, different from radiator 3 of FIG. 1 having the slit width of 2.5 mm, radiator 3B has slits 24B and 26B of which width is 5 mm. Except for this point, the radiator is the same as radiator 3 and, therefore, description thereof will not be repeated.

When radiator 3B is installed outdoors, adhesion of rain or snow can be prevented, as the slit is wide. Preferable width of the slit is from 1.0 mm to 10 mm, and more preferable range is 2.5 mm to 5 mm.

Figure 6:
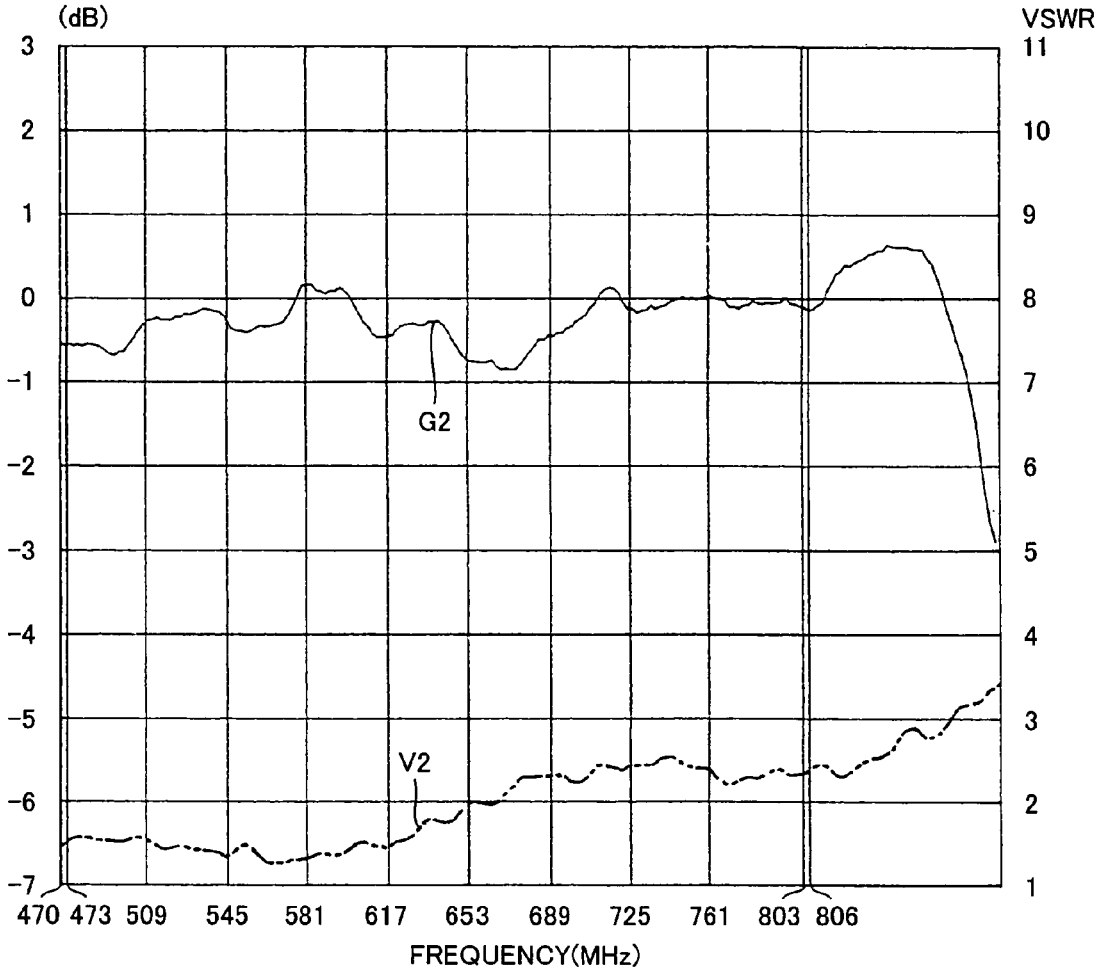
FIG. 6 is a graph representing a characteristic of a radiator 3B shown in FIG. 5.

FIG. 6 is a graph representing a characteristic of radiator 3B shown in FIG. 5.

Referring to FIG. 6, the abscissa represents frequency, and the ordinate represents gain and VSWR. A curve G2 represents variation in gain with respect to the frequency, and a curve V2 shows variation in VSWR with respect to the frequency.

FIGS. 6 and 2 will be compared. When curves G1 and G2 of gain are compared, it can be seen that variation with frequency is almost the same. When curves V1 and V2 of VSWR are compared, it can be seen that variation with frequency is, again, almost the same. In other words, even when the slit width of the radiator is made wider from 2.5 mm to 5 mm, characteristics of the radiator are not much influenced.

Figure 7:
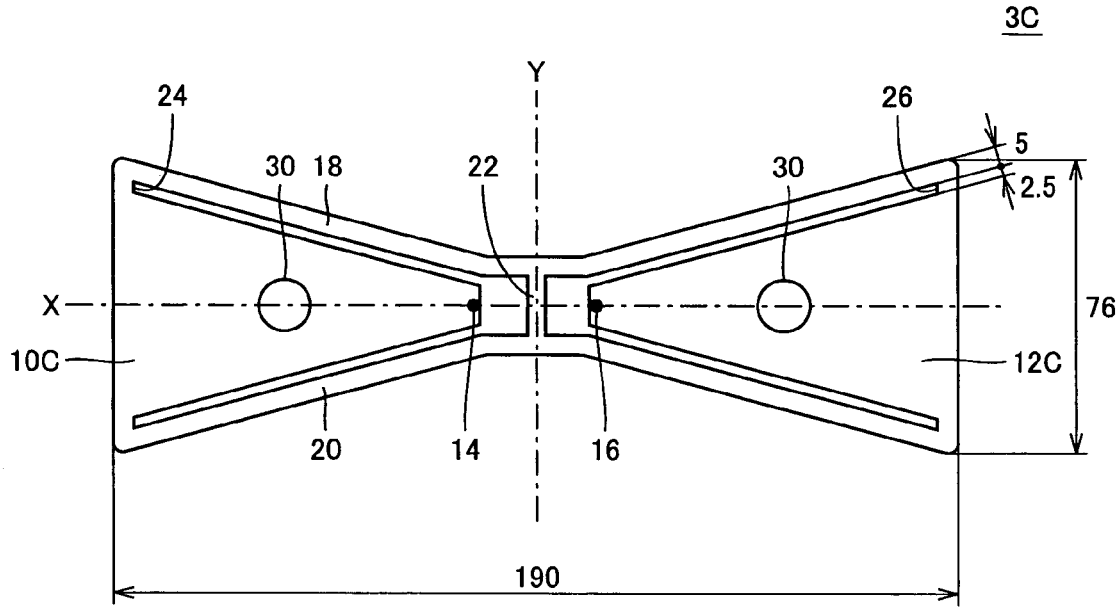
FIG. 7 shows a further variation of radiator 3 of FIG. 1.

FIG. 7 shows a further variation of radiator 3 of FIG. 1.

Referring to FIG. 7, a radiator 3C is different from radiator 3 of FIG. 1 in that holes 30 passing through dipole elements 10C and 12C are formed. Except for this point, the radiators are the same and, therefore, description thereof will not be repeated.

Such holes may be formed in view of design, for example, and such holes do not have much influence on the characteristics of the radiator. Though one hole is formed in each of dipole elements 10C and 12C in the example of FIG. 7, the number of holes is not limited, and the number, shape or size of the holes may be appropriately determined as needed.

Figure 8:
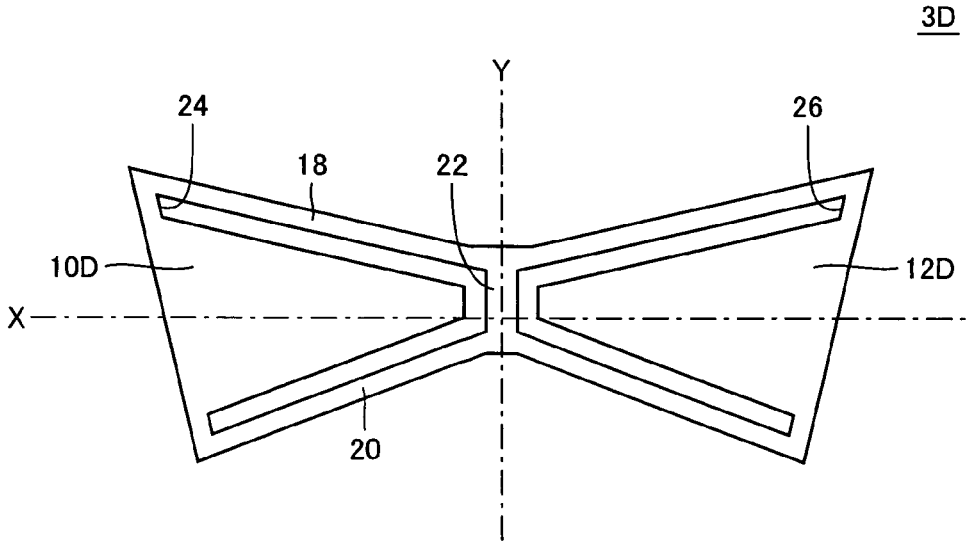
FIG. 8 shows a still further variation of radiator 3 of FIG. 1.

FIG. 8 shows a still further variation of the radiator of FIG. 1.

Referring to FIG. 8, a radiator 3D differs from radiator 3 of FIG. 1 in that dipole elements 10D and 12D are provided in place of dipole elements 10 and 12. Except for this point, it is the same as radiator 3 and, therefore, description thereof will not be repeated.

Dipole elements 10D and 12D are asymmetrical about the X-axis, and in this point, these elements differ from dipole elements 10 and 12 that are symmetrical about the X-axis. Characteristics of radiator 3D are similar to those of radiator 3, and hence, it follows that the dipole element may have a shape asymmetrical about the X-axis.

As described above, radiators 3 and 3B include two dipole elements widening along the Y-axis direction from the power feed points and two conductive line portions provided along the outer periphery of the dipole elements and having end portions bent to be connected to the dipole elements. Thus, radiators 3 and 3B can be made smaller than the conventional radiator, and variation in gain can be made smaller over a wide frequency range.

Figure 9:
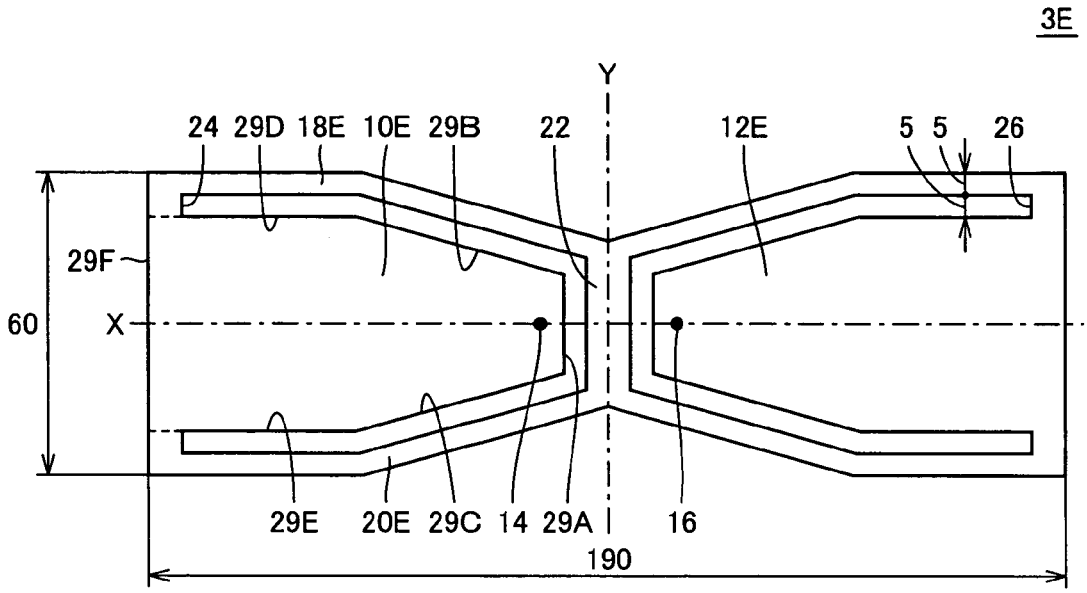
FIG. 9 shows a still further variation of radiator 3 of FIG. 1.

FIG. 9 shows a still further variation of radiator 3 of FIG. 1.

Referring to FIG. 9, a radiator 3E differs from radiator 3 of FIG. 1 in that dipole elements 10E and 12E are provided.

Each of the dipole elements 10E and 12E has a hexagonal shape, symmetrical about the X-axis. Dipole element 10E will be described as a representative. Dipole element 10E has a side 29A parallel to the Y-axis, sides 29B and 29C connected to opposite ends of side 29A and widening along the Y-axis, sides 29D and 29E parallel to the X-axis and connected to sides 29B and 29C, respectively, and a side 29F connected at opposite ends to sides 29D and 29E.

As dipole elements 10E and 12E have such shapes, the length of radiator 3E along the Y-axis becomes shorter than radiator 3 of FIG. 1. The length along the Y-axis is 76 mm in radiator 3, while the length along the Y-axis is 60 mm in radiator 3E. The length along the X-axis is 190 mm both in radiators 3 and 3E.

Figure 10:
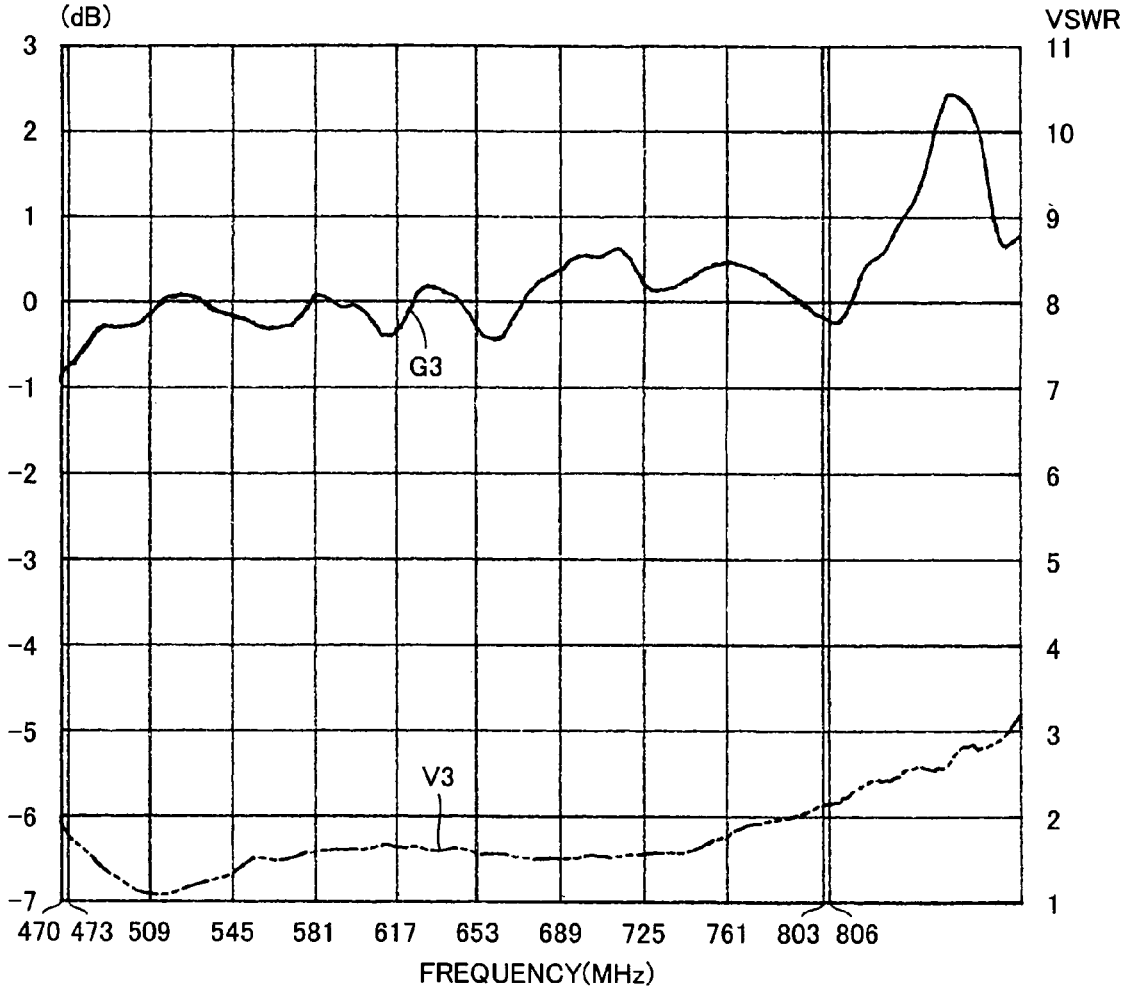
FIG. 10 is a graph representing a characteristic of a radiator 3E shown in FIG. 9.

FIG. 10 is a graph representing a characteristic of radiator 3E shown in FIG. 9.

Referring to FIG. 10, the abscissa represents frequency, and the ordinate represents gain and VSWR. A curve G3 represents variation in gain with respect to the frequency, and a curve V3 shows variation in VSWR with respect to the frequency.

FIGS. 10 and 2 will be compared. When curves G3 and G1 of gain are compared, it can be seen that curve G3 shows higher gain. When curves V3 and V1 of VSWR are compared, it can be seen that curve V3 shows smaller value of VSWR. Therefore, it follows that radiator 3E is smaller and has better characteristics than radiator 3.

Similar to radiators 3 and 3B, radiator 3E may be a press-worked sheet metal, or it may be formed by providing a metal film on an insulating substrate.

Further, dipole elements 10E and 12E may have holes formed therein, or the shapes of dipole elements 10E and 12E may be asymmetrical about the X-axis.

As described above, radiator 3E has dipole elements having smaller shapes than radiators 3 and 3B. As a result, the size of radiator 3E as a whole can be made smaller and, at the same time, the gain can be made higher and VSWR can be made lower than radiators 3 and 3B.

Figure 11:
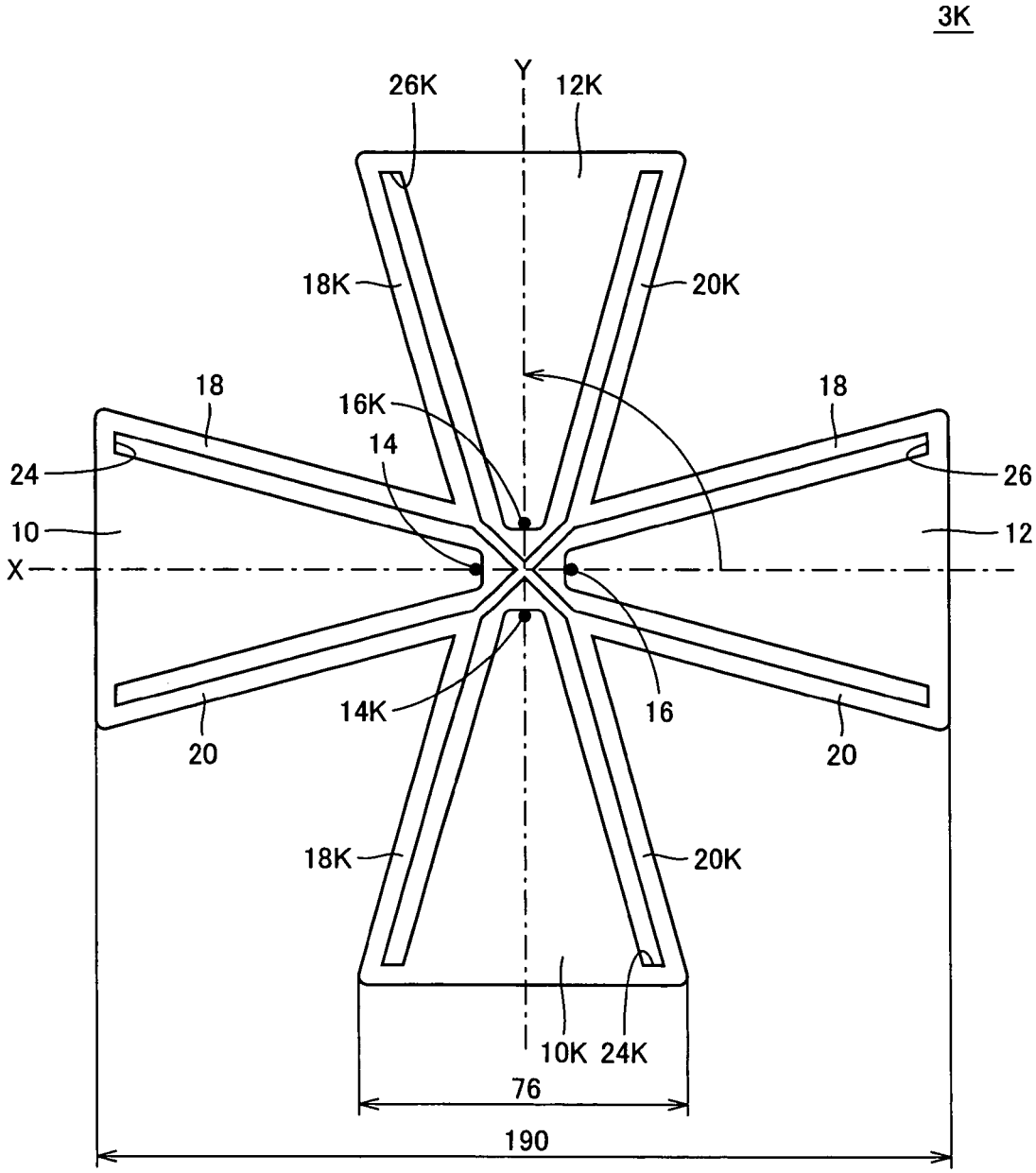
FIG. 11 shows an example including a combination of two radiators 3 of FIG. 1.

FIG. 11 shows an example having two radiators 3 of FIG. 1 combined.

Referring to FIG. 11, a radiator 3K is different from radiator 3 of FIG. 1 in that it additionally includes dipole elements 10K and 12K having respective power feed points 14K and 16K on the Y-axis, symmetrical in shape with each other about the X-axis and provided further outside of conductive line portions 18 and 20 of dipole elements 10 and 12, and conductive line portions 18K and 20K provided sandwiching both dipole elements 10K and 12K on opposite sides of the Y-axis, each having one end connected to a tip end portion of dipole element 10K and the other end connected to a tip end portion of dipole element 12K. Conductive line portions 18K and 20K are provided to extend between dipole elements 10 and 12. Between dipole element 10K and conductive line portion 18K and between dipole element 10K and conductive line portion 20K, slits 24K are formed. Similarly, between dipole element 12K and conductive line portion 18K and between dipole element 12K and conductive line portion 20K, slits 26K are formed. Other portions are the same as the corresponding portions of radiator 3 and, therefore, description thereof will not be repeated.

Radiator 3K has the same shape as a combination of two radiators 3 of FIG. 1, with one radiator rotated by 90° from the other radiator, about the crossing point of the X-axis and Y-axis. Characteristics of these two radiators included in radiator 3K are the same as those shown in FIG. 2 or 3 and, therefore, description thereof will not be repeated. Further, dipole elements 10K and 12K have the same shape as dipole elements 10 and 12, respectively.

Radiator 3K is included, for example, in a receiving antenna allowing directivity switching. When the receiving antenna is a Yagi antenna, it is installed fixed on a roof of a house or the like such that the directivity matches the direction of the transmitting antenna. When such an antenna is once fixed, it is difficult to change the directivity. Therefore, when there are a plurality of transmitting antennas dispersed, the receiving antenna receives only the broadcast signals transmitted from the transmitting antenna of the matching directivity.

In Japan, antenna directivity must sometimes be switched in a region extending across two reception areas. Further, it is often the case in the United States that each broadcasting station sets its own transmitting antenna, and therefore, it is necessary to switch directivity of the antenna every time a channel is switched.

Figure 12:
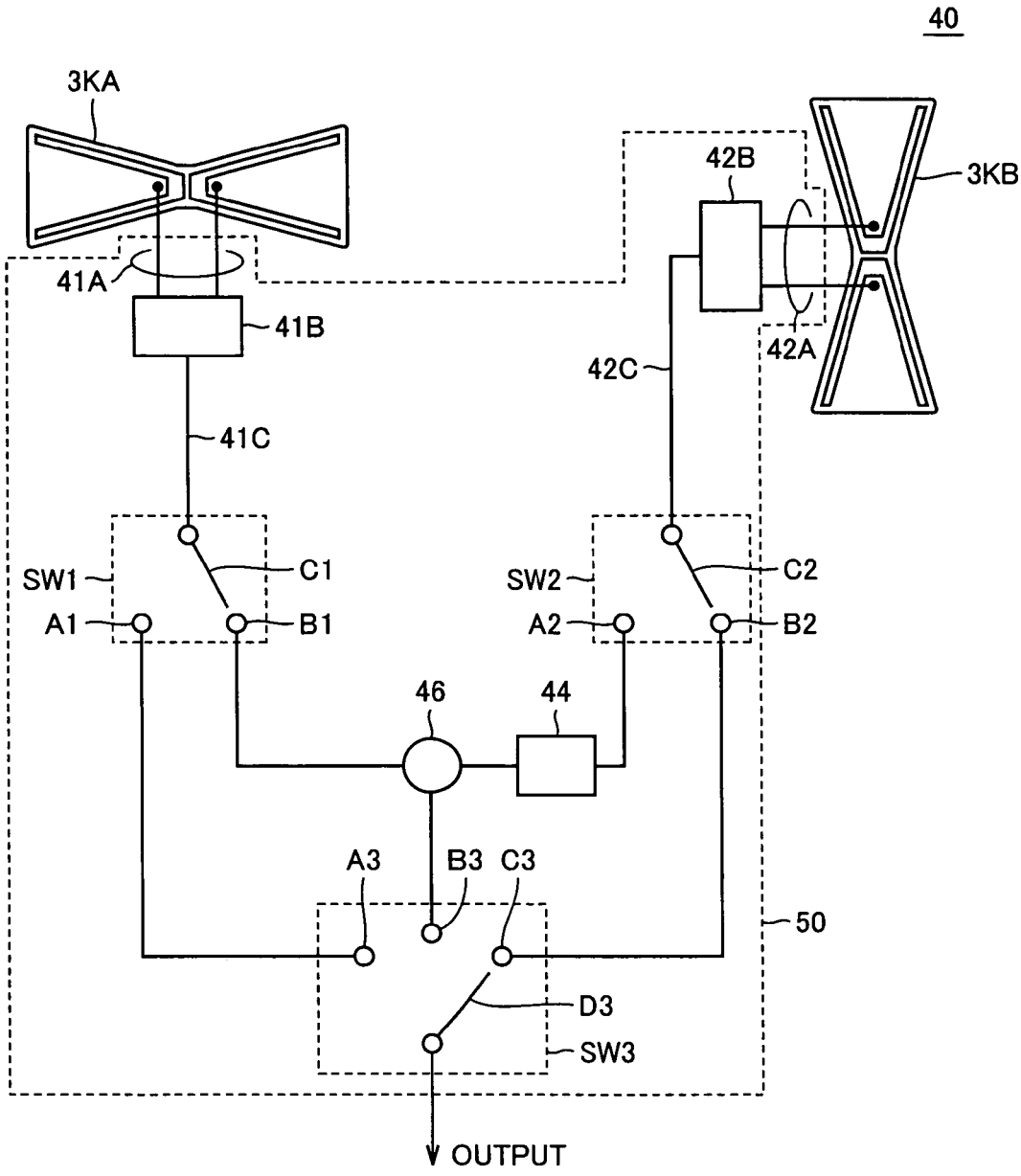
FIG. 12 shows an exemplary configuration of an antenna system including a radiator 3K shown in FIG. 11.

FIG. 12 shows an exemplary configuration of an antenna system including radiator 3K of FIG. 11.

Referring to FIG. 12, an antenna system 40 includes radiators 3KA and 3KB of the same shape. Each of radiators 3KA and 3KB corresponds to a part of radiator 3K shown in FIG. 11, and has the same shape as radiator 3 shown in FIG. 1. For convenience of description, radiator 3K will be shown as two independent radiators. It is noted that radiators 3KA and 3KB are provided such that they have perpendicularly crossing directivities.

Antenna system 40 further includes a variable directivity circuit 50. Variable directivity circuit 50 includes a feeder 41A connected to radiator 3KA, a matching box 41B connected to feeder 41A and performing impedance matching, a coaxial cable 41C connected to matching box 41B, and a switch SW1 for switching radio output transmitted from radiator 3KA to coaxial cable 41C.

Variable directivity circuit 50 further includes a feeder 42A connected to radiator 3KB, a matching box 42B connected to feeder 42A for performing impedance matching, a coaxial cable 42C connected to matching box 42B, and a switch SW2 for switching radio output transmitted from radiator 3KB to coaxial cable 42C.

Switch SW1 switches the output between terminal A1 and terminal B1, by means of a slider C1. Similarly, switch SW2 switches the output between terminal A2 and terminal B2, by means of a slider C2.

Variable directivity circuit 50 further includes a polarity inverter 44 connected to terminal A2 and inverting/non-inverting polarity of the radio wave received at radiator 3KB and outputting the result, a combiner 46 combining an output of terminal B1 of switch SW1 with the output of polarity inverter 44, and a switch SW3 switching output among terminal A1 of switch SW1, combiner 46, and terminal B2 of switch SW2. Switch SW3 switches the output by means of a slider D3.

Figure 13:
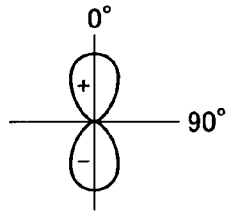
FIG. 13 shows, in the form of a table, directivity characteristics of an antenna system 40 shown in FIG. 12.
Figure 13:
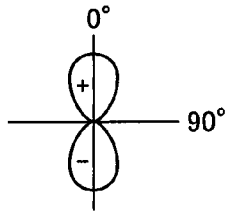
Figure 13:
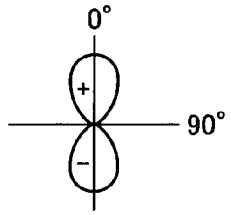
Figure 13:
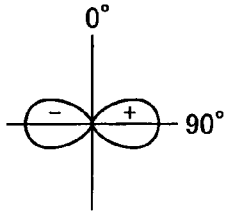
Figure 13:
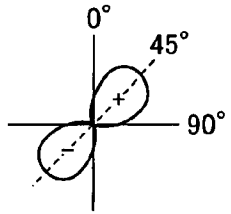
Figure 13:
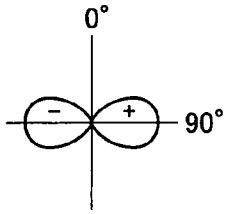
Figure 13:
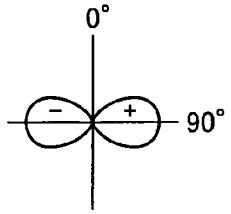
Figure 13:
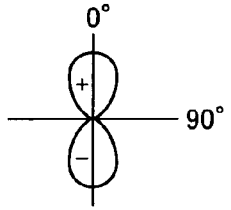
Figure 13:
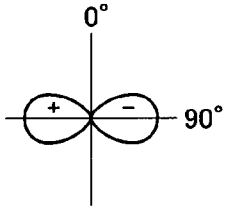
Figure 13:
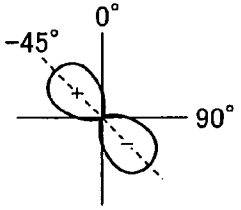

FIG. 13 represents, in the form of a table, directivity characteristics of antenna system 40 shown in FIG. 12.

FIG. 13 shows four directivity patterns. For each pattern, terminals with which sliders of switches SW1 to SW3 are in contact, respectively, and whether polarity inverter 44 inverted the polarity of input radio wave or not, are specified. FIG. 13 also shows, for each pattern, directivity characteristic of radiator 3KA, directivity characteristic desired in accordance with the radio wave output from polarity inverter 44 or the radio wave output from terminal B2 of switch SW2 (indicated as directivity characteristic of radiator 3KA in the figure), and the directivity characteristic desired in accordance with the radio wave output from switch SW3 (indicated as combined directivity characteristic in the figure).

In Pattern 1, slider C1 of switch SW1 is switched to the side of terminal A1, and slider D3 of switch SW3 is switched to the side of terminal A3. Slider C2 of switch SW2 may be in contact with terminal A2 or B2. When the radio wave received by radiator 3KB is to be output from terminal A2, polarity inverter 44 may or may not invert the polarity of the input radio wave. In Pattern 1, the combined directivity characteristic is the directivity characteristic of radiator 3KA itself, and the direction of maximum gain (where the received power attains the maximum) is the direction of 0°.

In Pattern 2, slider C1 of switch SW1 is switched to the side of terminal B1, slider C2 of switch SW2 is switched to the side of terminal A2, and slider D3 of switch SW3 is switched to the side of terminal B3. Further, polarity inverter 44 outputs the radio wave without inverting the polarity thereof. Here, the direction of maximum gain for the combined directivity characteristic is the direction of 45°.

In Pattern 3, slider C1 of switch SW1 may be in contact with terminal A1 or B1. Slider C2 of switch SW2 is switched to the side of terminal B2, and slider D3 of switch SW3 is switched to the side of terminal C3. Here, the combined directivity characteristic is the directivity characteristic of radiator 3KB itself, and the direction of maximum gain is the direction of 90°.

In Pattern 4, slider C1 of switch SW1 is switched to the side of terminal B1, slider C2 of switch SW2 is switched to the side of terminal A2, and slider D3 of switch SW3 is switched to the side of terminal B3. Polarity inverter 44 inverts the polarity of the input radio wave. The direction of maximum gain for the combined directivity characteristic is the direction of −45°. It is possible to switch directivity characteristic of antenna in such a manner.

Figure 14:
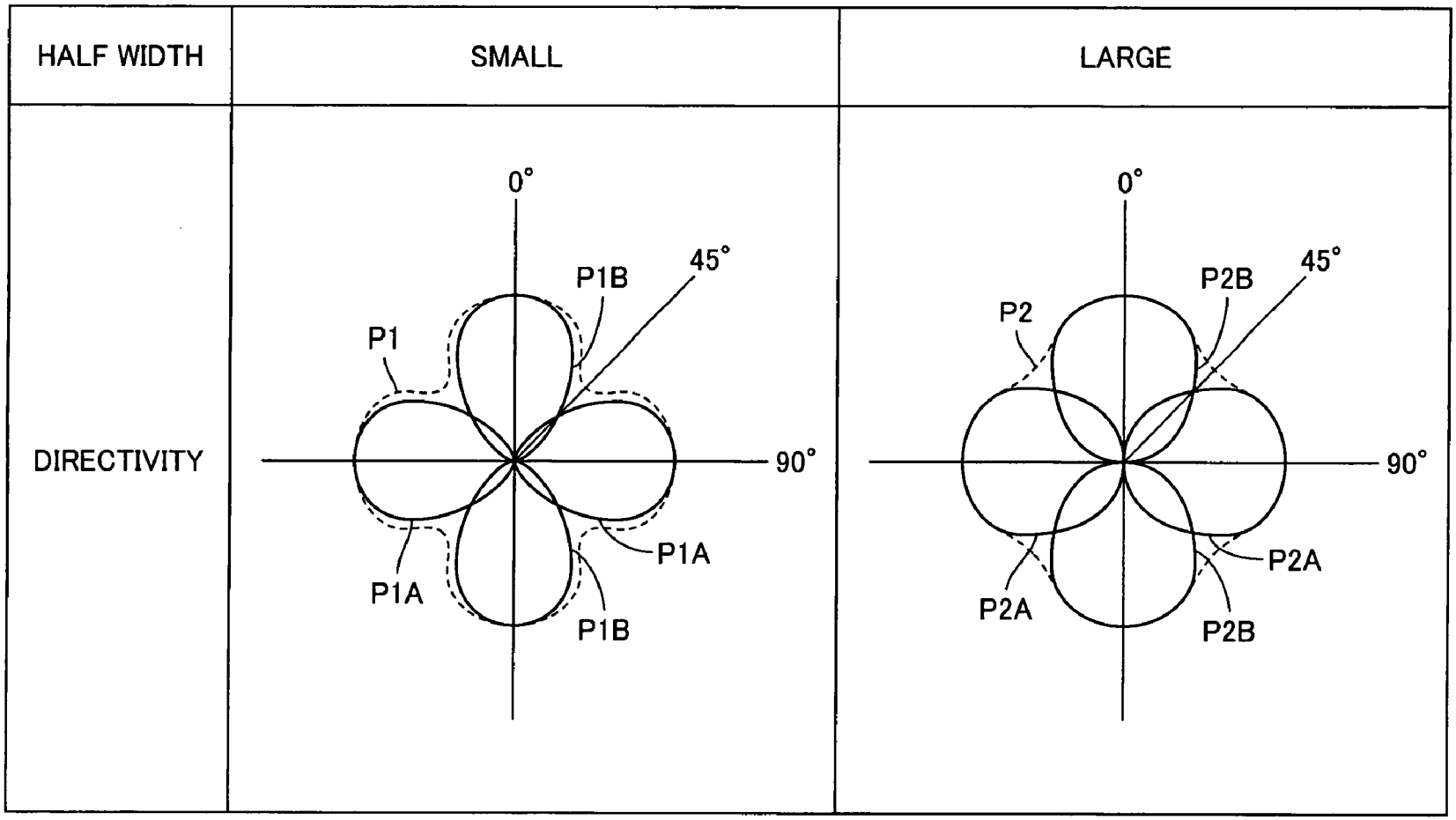
FIG. 14 schematically shows difference in antenna directivity dependent on the magnitude of half-width.

FIG. 14 schematically shows difference of antenna directivity derived from the magnitude of half-width.

FIG. 14 shows directivity curves different by 90° from each other and the result of combining these directivity curves, for a small half-width and a large half-width. A curve P1 represents directivity characteristic attained by combining curves P1A and P1B representing directivity characteristics different by 90° from each other. Similarly, a curve P2 represents directivity characteristic attained by combining curves P2A and P2B representing directivity characteristics different by 90° from each other. Half-width (beam width) of curves P1A and P1B is smaller than that of curves P2A and P2B. Curves P1 and P2 after combining are both recessed in the direction of 45. The depth of recess in the direction of 45° is deeper in curve P1.

Figure 20:
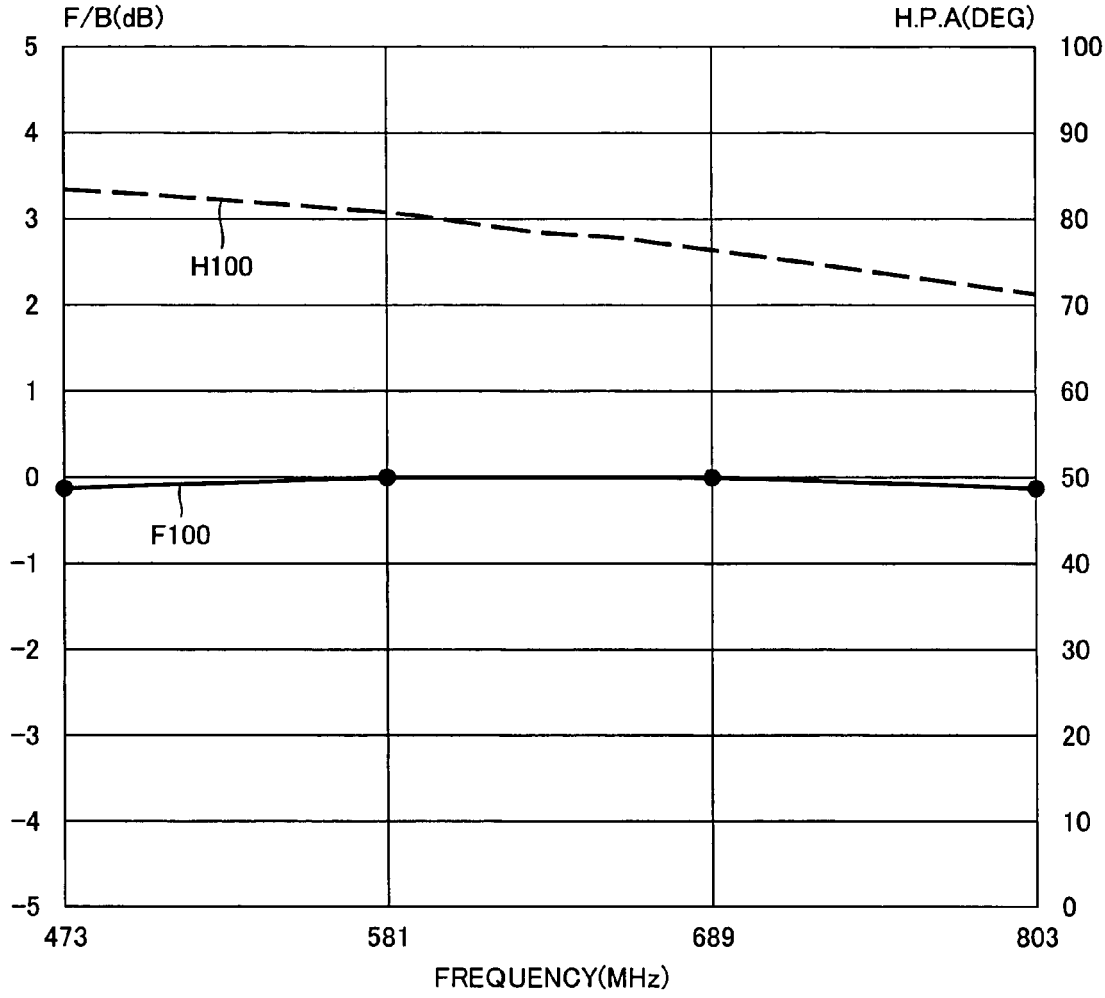
FIG.20 PRIOR ART
FIG. 20 is a graph representing another characteristic of radiator 103 shown in FIG. 18.

For each of radiators 3KA and 3KB shown in FIG. 12, the variation in half-width with respect to the frequency is as represented by the curve H1 of FIG. 3. When each of radiators 3KA and 3KB is replaced by radiator 103 of FIG. 18, the variation in half-width with respect to the frequency is as represented by the curve H100 of FIG. 20. As described above, decrease in half-width with the variation of frequency is more moderate in curve H1. As the frequency becomes higher, recess in the direction of 45° in the combined directivity characteristic becomes less likely in the antenna including radiators 3KA and 3KB (that is, the antenna having radiator 3K of FIG. 11), than in an antenna formed by combining the conventional radiators, and therefore, the antenna including radiators 3KA and 3KB is more convenient as a directivity-variable antenna.

Figure 15:
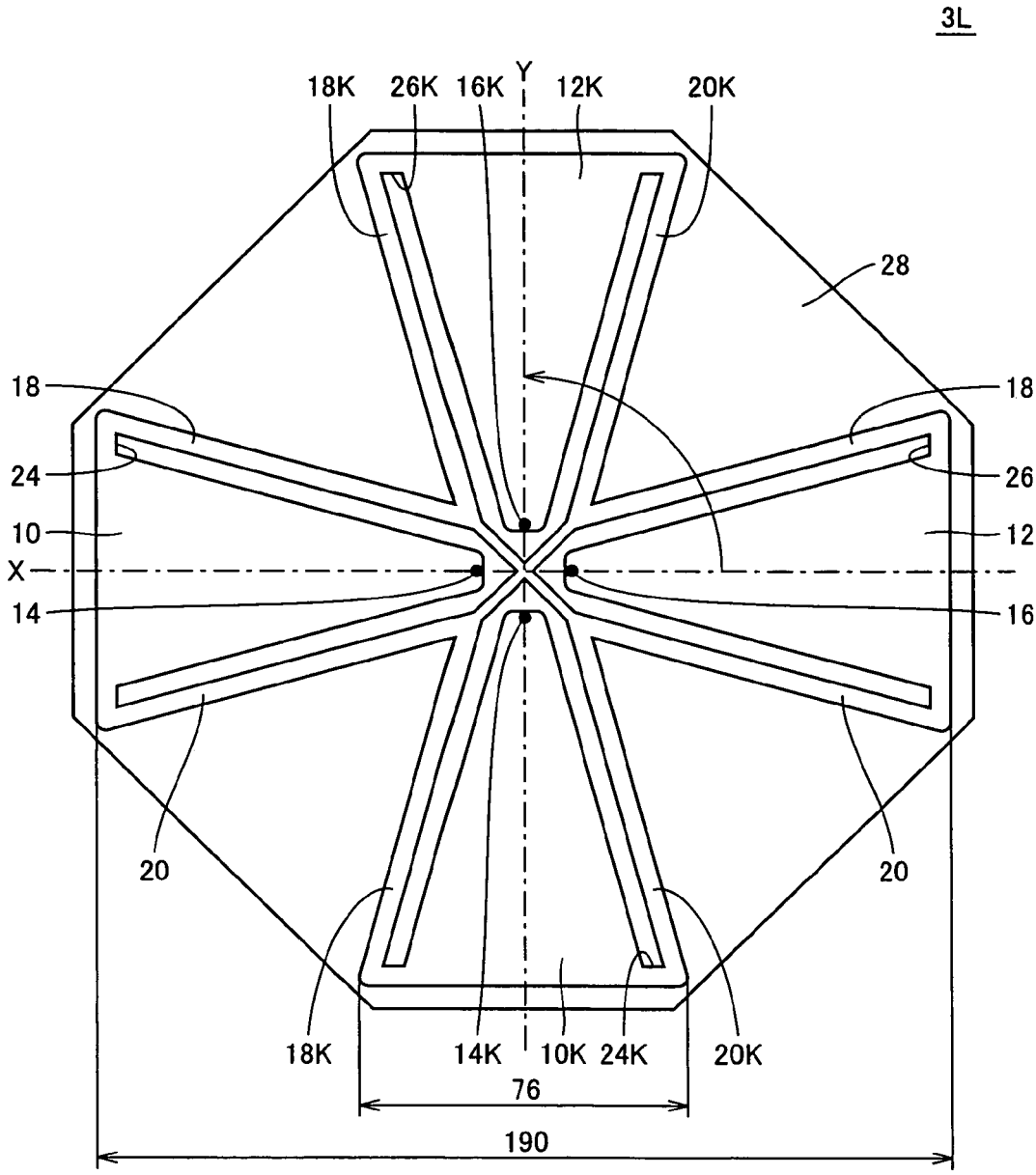
FIG. 15 shows a variation of radiator 3K of FIG. 11.

FIG. 15 shows a variation of radiator 3K of FIG. 11.

Referring to FIG. 15, a radiator 3L differs from radiator 3K of FIG. 11 in that it additionally includes an insulating substrate 28. Other portions are the same as those of radiator 3K and, therefore, description thereof will not be repeated. The reason why insulating substrate 28 is provided is to ensure sufficient strength when the radiator is installed outdoors. By the provision of insulating substrate 28, particularly the central portion of radiator 3L can be reinforced.

Figure 16:
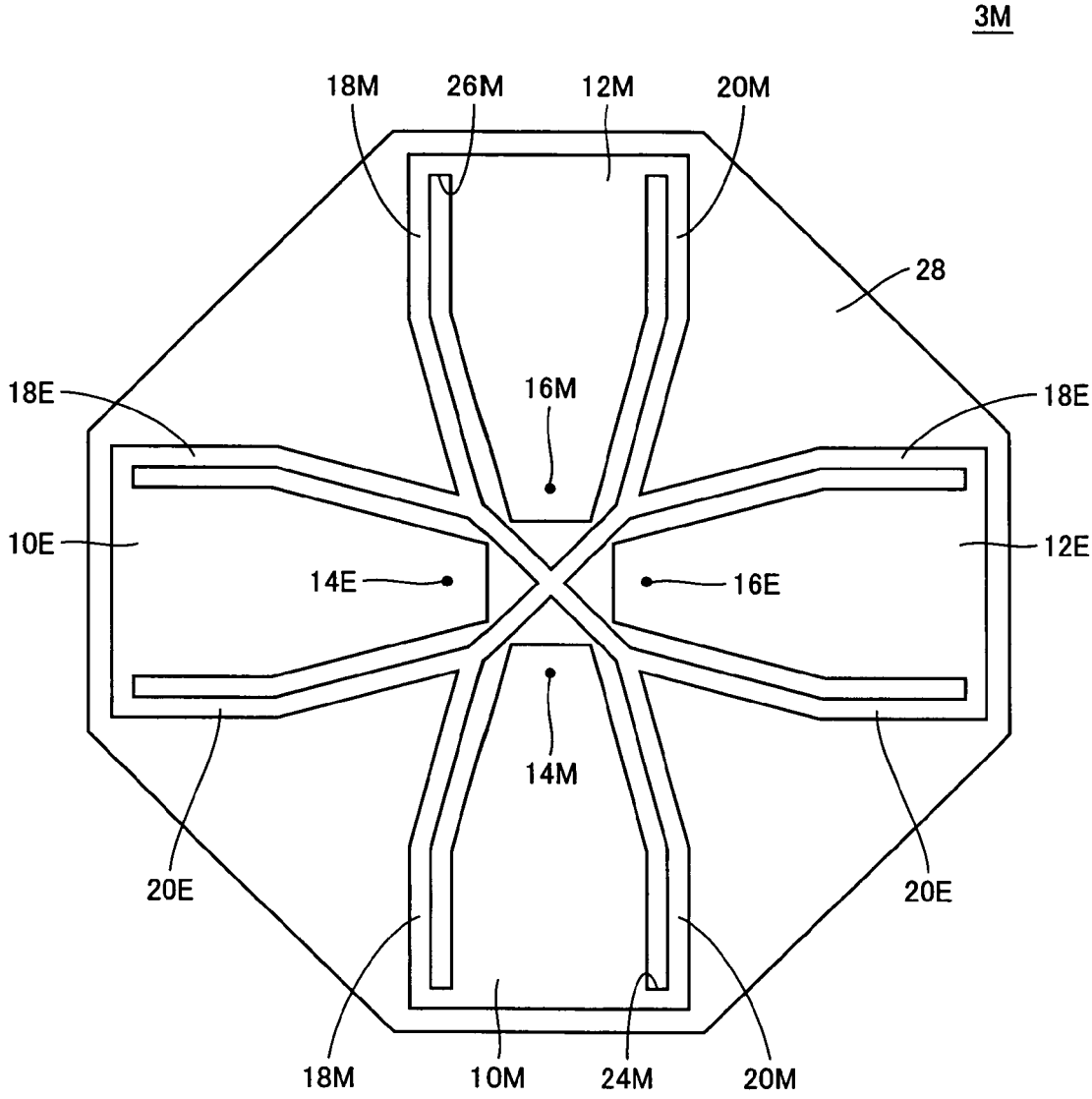
FIG. 16 shows another variation of radiator 3K of FIG. 11.

FIG. 16 shows another variation of radiator 3K of FIG. 11.

Referring to FIG. 16, a radiator 3M is different from radiator 3K in that it includes dipole elements 10E and 12E of FIG. 9 in place of dipole elements 10 and 12, and includes dipole elements 10M and 12M in place of dipole elements 10K and 12K. Dipole elements 10M and 12M correspond to dipole elements 10E and 12E rotated by 90° about the crossing point of the X-axis and the Y-axis. With the dipole elements adapted to have such a shape, the radiator can be made smaller than radiator 3K.

Further, radiator 3M is different from radiator 3K of FIG. 11 in that it additionally includes insulating substrate 28. As in the case of radiator 3L, insulating substrate 28 is provided for ensuring strength. Other portions of radiator 3L are the same as those of radiator 3M and, therefore, description thereof will not be repeated.

As a further modification, dipole elements 10 and 12 and dipole elements 10K and 12K of radiator 3K, for example, may be replaced by dipole elements having the same shape as dipole elements 10C and 12C of FIG. 7, respectively.

Figure 17:
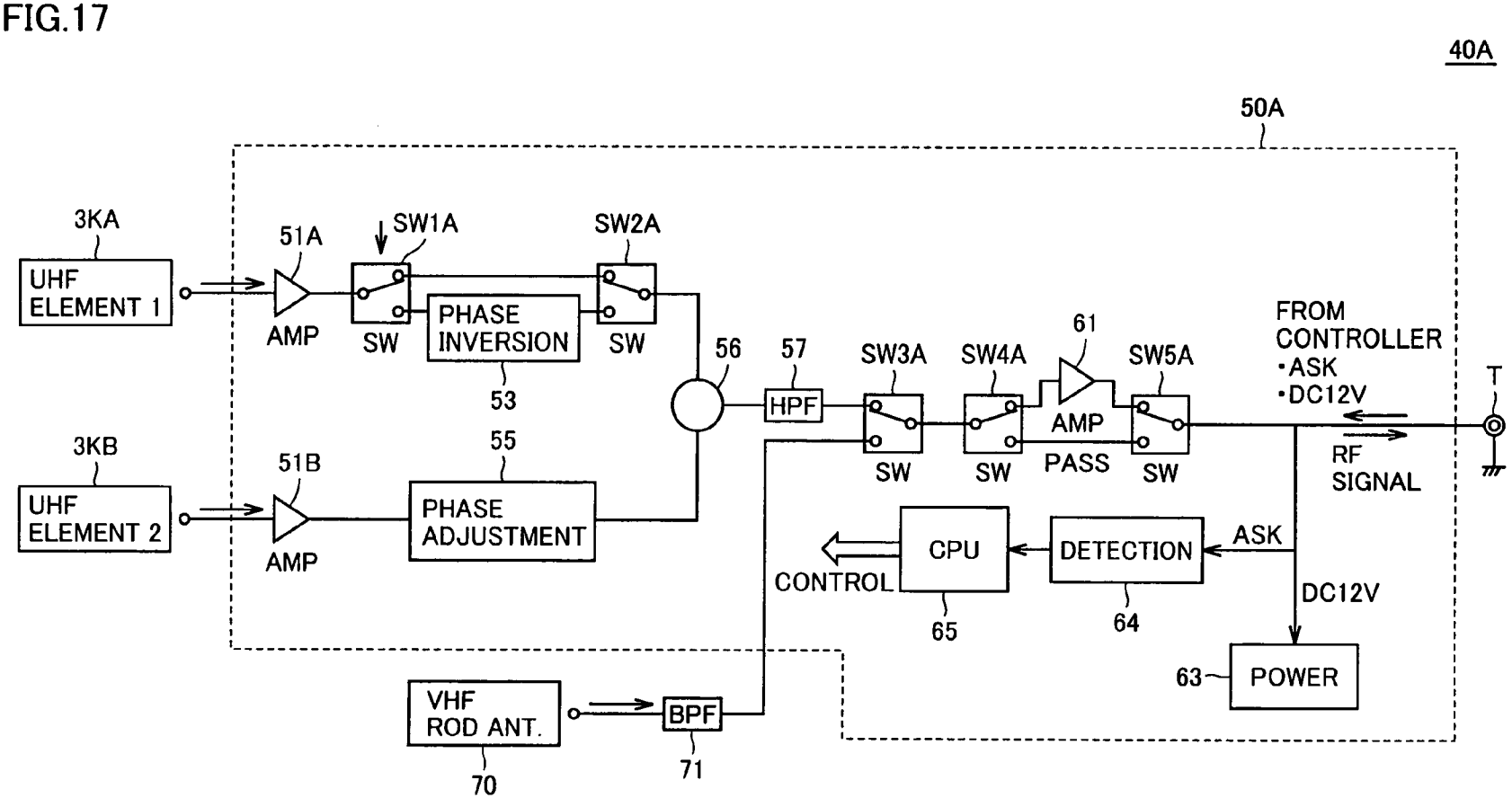
FIG. 17 shows another system configuration of the antenna in accordance with an embodiment.

FIG. 17 shows another system configuration of the antenna in accordance with an embodiment.

Referring to FIGS. 17 and 12, an antenna system 40A is different from antenna system 40 in that it includes a variable directivity circuit 50A in place of variable directivity circuit 50. Further, different from antenna system 40, antenna system 40A additionally includes a VHF antenna 70 and a band pass filter 71. VHF antenna 70 is implemented, for example, by a rod antenna. Therefore, in FIG. 17, VHF antenna 70 is denoted by "VHF Rod Ant."

Other portions of antenna system 40A are the same as the corresponding portions of antenna system 40 and, therefore, description thereof will not be repeated.

Variable directivity circuit 50A includes amplifiers 51A, 51B and 61, switches SW1A to SW5A, a phase inverting circuit 53, a phase adjusting circuit 55, a combiner 56, a high-pass filter 57, a power supply circuit 63, a detection circuit 64, and a CPU (Central Processing Unit) 65. In FIG. 17, radiators 3KA and 3KB are denoted by "UHF Element 1" and "UHF Element 2", respectively.

Amplifiers 51A and 51B amplify signals output from radiators 3KA and 3KB, respectively. Switches SW1A and SW2A switch whether the signal output from amplifier 51A is to be passed to phase inverting circuit 53 or not. Phase inverting circuit 53 inverts the phase of an input signal. Phase adjusting circuit 55 adjusts the phase of the input signal, to establish a prescribed relation between the phase of the signal output from switch SW2A and the phase of an output signal from phase adjusting circuit 55.

Combiner 56 combines the output signal from switch SW2A and the output signal from phase adjusting circuit 55. The output from combiner 56 is input through a high-pass filter 57 to switch SW3A. Meanwhile, the signal of VHF band received by VHF (Very High Frequency) antenna 70 is input through a band pass filter 71 to switch SW3A. Switch SW3A selectively outputs the UHF band signal or VHF band signal.

Switches SW4A and SW5A switch whether the signal output from switch SW3A is to be passed to amplifier 61 or not. When the level of the signal output from switch SW3A is low, the signal is amplified by amplifier 61. The signal output from switch SW5A (RF signal) is output to a receiving apparatus (such as a tuner), not shown, from a terminal T.

Terminal T receives an ASK (Amplitude Shift Keying) signal from the receiving apparatus and a DC voltage (for example, DC 12V). The DC voltage input to terminal T is supplied to power supply circuit 63 through a high-frequency preventing coil (not shown). Power supply circuit 63 supplies the voltage to CPU 65, amplifiers 51A, 51B, 61 and the like. Further, the ASK signal supplied to terminal T is input to CPU 65 through detection circuit 64. Based on the input signals, CPU 65 controls each of the switches SW1A to SW5A.

The radiator included in antenna system 40 is not limited to radiators 3KA and 3KB (that is, radiator 3K shown in FIG. 11), and it may be radiator 3L shown in FIG. 15 or radiator 3M shown in FIG. 16.

As described above, according to the embodiment of the present invention, the antenna includes two radiators combined to cross at right angles with each other. Each of the two radiators includes two dipole elements extending along a prescribed axial direction when viewed from power feed points, and two conductive line portions provided along the outer periphery of the dipole elements and having end portions bent to be connected to respective dipole elements. Therefore, according to the present embodiment, the antenna can be made smaller than a conventional antenna, and higher performance can be attained.

Further, according to the present embodiment, an antenna that has better reception characteristic than a conventional antenna even when directivity is switched can be realized.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna, comprising first and second dipole elements respectively having power feed points provided on a first axis, and symmetrical in shape with each other about a second axis perpendicularly crossing said first axis at a mid point of a line connecting said respective power feed points; wherein said first and second dipole elements are formed, at least partially, to be wider in a direction of said second axis away from the mid point, from said second axis along said first axis; said antenna further comprising first and second conductive line portions provided on opposite sides of said first axis, sandwiching both said first and second dipole elements, each having one end connected to a tip end portion of said first dipole element and the other end connected to a tip end portion of said second dipole element; wherein said first and second conductive line portions are formed conforming to the shapes of said first and second dipole elements.

2. The antenna according to claim 1, wherein said antenna includes third and fourth dipole elements respectively having power feed points on said second axis and symmetrical in shape with each other about said first axis, provided outer than said first and second conductive line portions with respect to said first and second dipole elements; and third and fourth conductive line portions provided on opposite sides of said second axis, sandwiching both said third and fourth dipole elements, each having one end connected to a tip end portion of said third dipole element and the other end connected to a tip end portion of said fourth dipole element; wherein the third and fourth conductive line portions are provided to extend between said first dipole element and said second dipole element.

3. The antenna according to claim 2, wherein said third and fourth dipole elements have the same shape as said first and second dipole elements, respectively and said first and second dipole elements each include a first side parallel to said second axis, second and third sides each having one end connected to opposite ends of said first side and widening in a direction of said second axis, fourth and fifth sides parallel to said first axis and connected to the other end of said second and third sides, respectively, and a sixth side having opposite ends connected to said fourth and fifth sides, respectively.

4. The antenna according to claim 2, wherein a space between said first dipole element and said first conductive line portion, a space between said second dipole element and said first conductive line portion, a space between said first dipole element and said second conductive line portion, and a space between said second dipole element and said second conductive line portion are in a range from at least 1 mm and at most 10 mm.

5. The antenna according to claim 2, further comprising an insulating substrate having a surface for supporting said first to fourth dipole elements and said first to fourth conductive line portions on one same plane.

6. The antenna according to claim 2, wherein said first to fourth dipole elements and said first to fourth conductive line portions are formed integrally in a plate shape.

7. The antenna according to claim 2, further comprising a variable directivity circuit changing antenna directivity by controlling power feeding to said first and second dipole elements and power feeding to said third and fourth dipole elements.

8. The antenna according to claim 2, receiving radio wave of UHF (Ultra High Frequency) band.

* * * * *